US012650256B2

(12) United States Patent
Sharma et al.

(10) Patent No.: US 12,650,256 B2
(45) Date of Patent: Jun. 9, 2026

(54) ACCESSIBLE COOLING ENVIRONMENT

(71) Applicant: KPS GLOBAL LLC, Fort Worth, TX (US)

(72) Inventors: Rahul Sharma, Fort Worth, TX (US); James M. Costanza, Flower Mound, TX (US)

(73) Assignee: KPS GLOBAL LLC, Fort Worth, TX (US)

( * ) Notice: Subject to any disclaimer, the term of this patent is extended or adjusted under 35 U.S.C. 154(b) by 183 days.

(21) Appl. No.: 18/568,595

(22) PCT Filed: Jun. 2, 2022

(86) PCT No.: PCT/US2022/031873

§ 371 (c)(1),
(2) Date: Dec. 8, 2023

(87) PCT Pub. No.: WO2022/260917

PCT Pub. Date: Dec. 15, 2022

(65) Prior Publication Data

US 2024/0280312 A1 Aug. 22, 2024

Related U.S. Application Data

(60) Provisional application No. 63/208,382, filed on Jun. 8, 2021.

(51) Int. Cl.
*F25D 21/00* (2006.01)
*F25D 21/08* (2006.01)

(52) U.S. Cl.
CPC ..... *F25D 21/006* (2013.01); *F25D 21/08* (2013.01); *F25B 2700/21172* (2013.01); *F25B 2700/21173* (2013.01)

(58) Field of Classification Search
CPC ..... F25D 21/006; F25D 2700/21; F25B 2700/21172; F25B 2700/21173
See application file for complete search history.

(56) References Cited

U.S. PATENT DOCUMENTS 4,151,723 A 5/1979 Gardner
5,046,324 A * 9/1991 Otoh ..... F25D 21/006 62/155

(Continued)

FOREIGN PATENT DOCUMENTS

EP 2757335 B1 8/2018
EP 3786553 A1 3/2021

(Continued)

OTHER PUBLICATIONS

International Search Report and Written Opinion for Application No. PCT/US2022/31873, dated Sep. 20, 2022.

(Continued)

*Primary Examiner* — Lionel Nouketcha
(74) *Attorney, Agent, or Firm* — MARSHALL, GERSTEIN & BORUN LLP

(57) ABSTRACT

An example control system for a temperature controlled environment operates by alternatively executing on-cycles during which the controller controls the compressor to operate in an on-state and off-cycles during which the controller controls the compressor to operate in an off-state. During the off-cycle the control system executes a defrost cycle. To reduce power consumption of the temperature controlled environment, the control system executes a particular defrost cycle during the off-cycle based upon a stored indication of defrost cycle type.

20 Claims, 9 Drawing Sheets

(56) References Cited

U.S. PATENT DOCUMENTS

| | | | | | |
|---|---|---|---|---|---|
| 5,507,154 | A * | 4/1996 | Grant | F25D 21/006 | 62/81 |
| 5,694,782 | A * | 12/1997 | Alsenz | F25B 5/02 | 62/278 |
| 2007/0033955 | A1* | 2/2007 | Luo | F25B 47/025 | 62/151 |
| 2007/0186569 | A1* | 8/2007 | Street | G05D 23/24 | 62/157 |
| 2008/0092569 | A1* | 4/2008 | Doberstein | F25D 21/006 | 62/156 |
| 2013/0098075 | A1* | 4/2013 | Hegedus | F25D 17/045 | 62/426 |
| 2015/0184920 | A1* | 7/2015 | Vie | F25D 21/008 | 62/155 |
| 2018/0031289 | A1* | 2/2018 | Hern | F25B 47/025 | |
| 2021/0018201 | A1* | 1/2021 | Tice | F24F 11/76 | |

FOREIGN PATENT DOCUMENTS

| | | | |
|---|---|---|---|
| KR | 20180001936 | A | 1/2018 |
| WO | WO-2020/230178 | A1 | 11/2020 |

OTHER PUBLICATIONS

European Patent Application No. 22820792.4, Extended European Search Report, dated Feb. 26, 2025.

* cited by examiner

ACCESSIBLE COOLING ENVIRONMENT

FIELD OF THE DISCLOSURE

The present disclosure generally relates to an open-walled, temperature controlled environment, and more particularly, to control systems for the open-walled, temperature controlled environment.

BACKGROUND

Temperature controlled environments are configured to cool a space to a set point temperature. In many temperature controlled environments, temperature-sensitive products (e.g., food, medicine) are disposed in the cooled space. If a temperature-sensitive product is exposed to inappropriate temperatures, the temperature-sensitive items may be spoiled or become otherwise unusable.

While conventional temperature controlled environment control systems may be sufficient in ideal operating conditions, often applying conventional techniques in open-front (or other open-walled) refrigeration systems causes a buildup of frost and/or ice on evaporator coils. This is particularly likely to occur when the temperature controlled environment is disposed in a humid location. As a result, the conventional systems are often unable to achieve set point temperatures during normal operation. Thus, conventional temperature controlled environments must have lengthy down times to fully defrost the evaporator coil or perform power-intensive defrost techniques that incur additional expenses to temperature controlled environment operators. In view of the foregoing problems, there is a need for improved control systems for temperature controlled environments to more efficiently defrost evaporator coils.

SUMMARY

In an embodiment, a control system for a temperature controlled environment is provided. The control system includes (i) a controller operatively connected to: (a) an evaporator configured to receive refrigerant that flows from an input of an evaporator coil to an output of the evaporator coil; (b) a compressor configured to receive the refrigerant from the output of the evaporator coil and compress the received refrigerant; (c) a condenser configured to receive refrigerant from the compressor, condense the refrigerant, and provide the refrigerant to the input of the evaporator coil; and (d) at least one sensor configured to capture sensor data indicating a temperature associated with the evaporator coil; and (ii) one or more memory units communicatively coupled to the controller and storing (i) an indication of a defrost cycle type, and (ii) executable instructions that, when executed by the controller, cause the controller to alternatively (1) execute an on-cycle during which the controller controls the compressor to operate in an on-state to cool the temperature controlled environment to a set point temperature; and (2) execute an off-cycle during which (i) the controller controls the compressor to operate in an off-state, and (ii) the controller executes a defrost cycle based upon the stored indication of the defrost cycle type. Other embodiments include methods and non-transitory computer readable media for controlling the control system in accordance with the provided control system.

DETAILED DESCRIPTION

The present disclosure is generally directed to control systems for an open-walled, temperature controlled environment ("TCE") unit, which may be a standalone unit or configured in a layout comprising a plurality of TCE units. The TCE unit may replace existing small and large scale refrigeration solutions by providing an energy-efficient refrigerated environment that is easy to construct and provides a comfortable shopping experience for the consumer. While the instant disclosure details how the control systems are implemented at a TCE unit, the control systems described herein may be implemented in other temperature controlled environments, such as commercial or consumer refrigerators, walk-in coolers, open-front refrigerated cases, refrigerated reach-in display cases, air conditioning units, etc.

Figure 1:
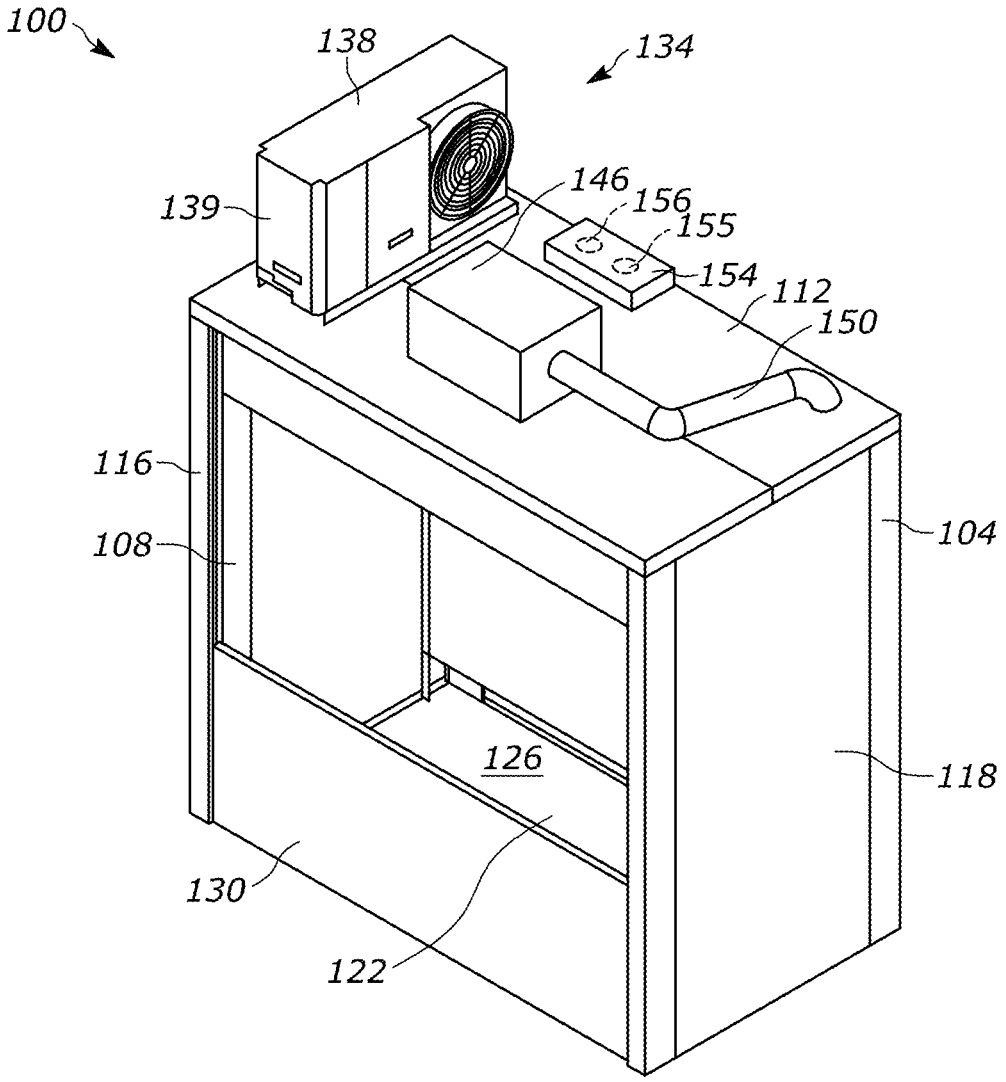
FIG. 1 is a perspective view of an open-walled, temperature controlled environment ("TCE") unit assembled in accordance with the teachings of the present disclosure.

In FIG. 1, a TCE unit 100 is assembled in accordance with the teachings of the present disclosure. The TCE unit 100 is a partially enclosed, refrigerated storage space including a back wall 104, an opening 108 opposite the back wall 104, a roof 112, and first and second side walls 116, 118 that partially define the opening 108. An interior space 122 is defined by a ground or floor surface 126, the back wall 104, roof panel 112, and first and second side walls 116, 118. A barrier 130 also at least partially defines the interior space 122 and is disposed in the opening 108 between the first and second side walls 116, 118. The barrier 130 sealingly engages the floor or ground 126 when in the closed position, and is movable to an open position, in which the barrier 130 is spaced away from the floor or ground 126. As will be discussed further below, the barrier 130 provides the TCE unit 100 with both a physical and thermal barrier from the external environment.

The TCE unit 100 has a refrigeration system 134 that maintains the temperature of the interior, and distributes refrigerated air throughout the interior space 122. The refrigeration system 134 includes a condenser unit 138 disposed on the roof 112, an evaporator 142 (shown in FIG. 2) disposed in the interior space 122, a blower 146 disposed on the roof 112, and an insulated duct 150 connecting the blower 146 and the interior space 122 of the TCE unit 100. The condenser unit 138 includes a compressor 139 configured to compress a refrigerant and a condenser in which the refrigerant is cooled into a liquid form which is cooled via the condenser. The evaporator 142 receives the refrigerant from the condenser and uses the refrigerant to extract heat from the air blowing across the coil of the evaporator 142. The cooled air is then distributed through the interior space 122 via the evaporator fan 162.

A control system 154 is disposed on the roof 112, the interior space 122, or in the evaporator 142, and is coupled to the refrigeration system 134 to monitor, analyze, and control the refrigeration system 134 of the TCE unit 100. It should be appreciated that the control system 154 may be configured to directly or indirectly control the components of the refrigeration system 134. For example, in the indirect control scenario, the evaporator may include an electronic expansion valve (EEV) which, when closed via the control system 154, causes an increased pressure to be a sensed at the condenser of the condenser unit 138 to cause the condenser to switch off. Additionally, the control system 154 is configured to execute a plurality of on-cycles and off-cycles associated with operation of the compressor 139 of the condenser unit 138. To this end, during an on-cycle, the compressor 139 is in an on-state and compresses the refrigerant to begin the cooling process. On the other hand, during an off-cycle, the compressor 139 is in an off-state, thereby pausing the cooling process.

Figure 5:
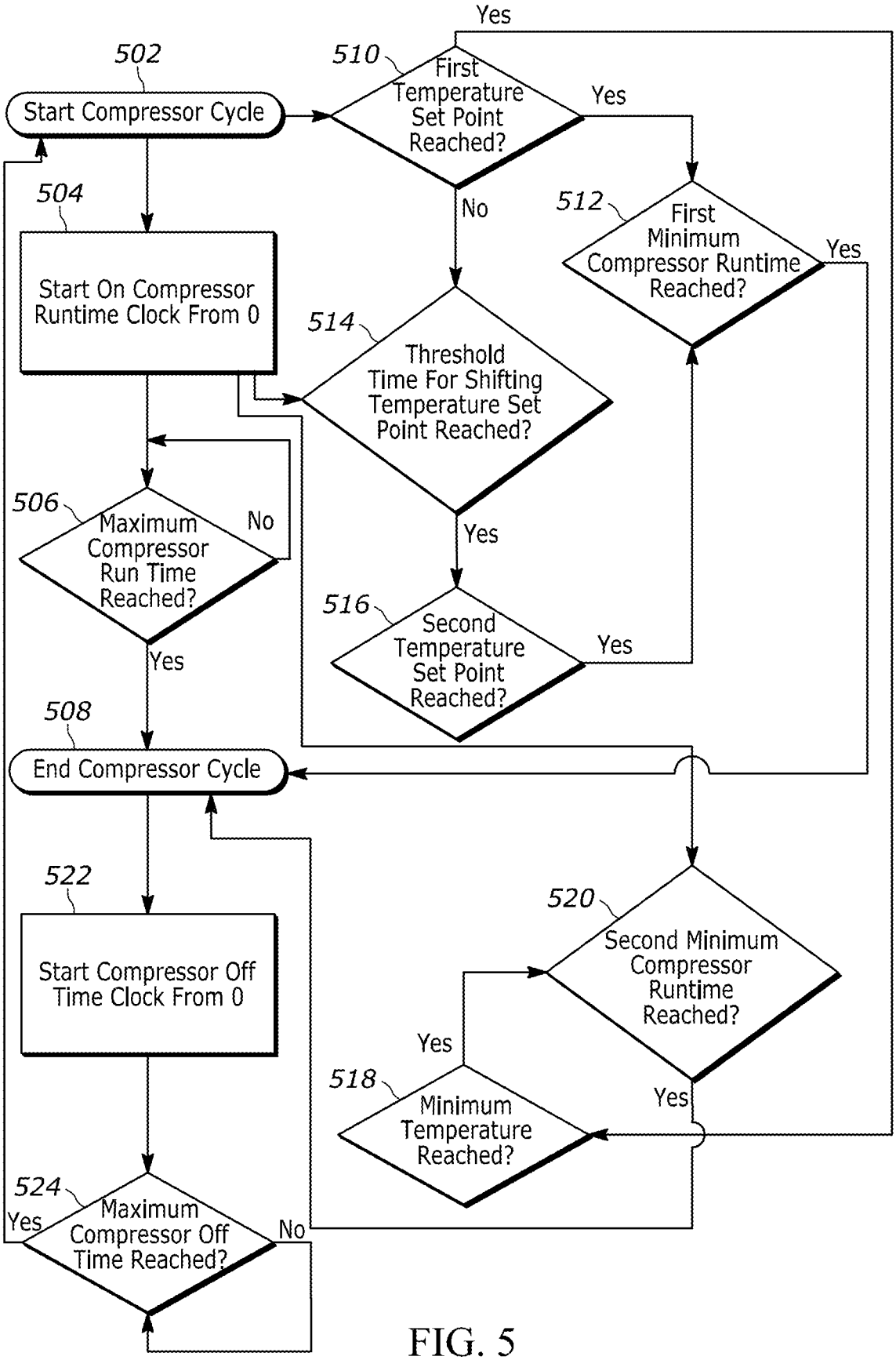
FIG. 5 is a flow diagram indicating the control logic for executing compressor on-cycle 402 of FIG. 4 in accordance with the teachings of the present disclosure.

As discussed in greater detail with respect to FIG. 5, the control system 154 may be configured to switch the compressor 139 from the on-state to the off-state based on one of several possible threshold conditions being reached. For instance, in an example, the control system 154 may be configured to track the time since the start of the on-state of the compressor 139, and switch the compressor 139 from the on-state to the off-state based on the elapsed time reaching a maximum compressor runtime within a given compressor cycle. This maximum compressor runtime may be programmable by a user. Advantageously, the user-programmable maximum compressor runtime per cycle provided herein allows for better control of product temperature, based on the needs of the user (i.e., for the particular temperature controlled environment and/or the particular product(s) being cooled), compared to conventional systems. That is, conventional systems may implement a cumulative maximum compressor runtime for multiple cycles (i.e., a static maximum compressor runtime), but not a maximum compressor runtime per compressor cycle (i.e., a dynamic maximum compressor runtime). Thus, in conventional systems, compressors may be switched from an on-state to an off-state only when a specific temperature set point is reached, without taking into account how long the compressor has been running (i.e., as long as the minimum compressor runtime has been reached). However, if the compressor 139 is running for an extended period of time without reaching a temperature set point, this may indicate that there is an issue with the compressor 139 or with other parts of refrigeration system 134. Moreover, in high humidity conditions, the time needed to cool the interior space 122 may increase due to increased refrigeration load, and during this time, ice may build up on the evaporator, further increasing the time needed to cool the interior space 122, which leads to more ice buildup, which in turn leads to increased time required to cool the interior space 122, etc., all of which is to say that in high humidity conditions, it may be important to end the on-cycle of the compressor 139 after the maximum runtime per compressor cycle so that defrosting can occur to prevent the buildup of ice and frost on the evaporator 142. Consequently, the implementation of the maximum compressor runtime prevents the compressor 139 from running indefinitely while experiencing such issues and allowing the product(s) to warm.

During the off-cycle, the control system 154 may be configured to perform the defrost cycles disclosed herein in order to keep the evaporator 142 functioning at high efficiency and without a buildup of frost thereon. The control system 154 may be operated remotely or locally to operate the defrost cycle, change temperature or fan speed, or control and/or operate other functions of the refrigeration system 134. The control system 154 may include one or more sensors coupled to the evaporator 142 or other areas in the interior space 122 of the TCE unit 100, one or more processors 155, and a memory 156 for storing executable instructions that enables automatic operation of the on-cycle, off-cycle, defrost cycle and/or other features or programs of the refrigeration system 134. While the refrigeration and control systems 134, 154 are arranged on (or near) the roof 112 of the TCE unit, in other examples, the refrigeration and control systems 134, 154 may be arranged differently. For example, the blower 146, the condenser unit 138, and the control system 154 may be disposed on the exterior of the TCE unit 100, on the ground 126, or attached to any of the panels defining the TCE unit 100.

The roof 112, sidewalls 116, 118, and back wall 104 of the TCE unit 100 of FIG. 1 are preferably constructed using connected insulated panels. The roof 112 may be constructed of one or more insulated panels joined together. Similarly, each of the first and second side walls 116, 118 includes a single insulated panel that is connected to the both the roof 112 and the back panel 104 via insulated frames. The back panel 104 may include one or more joined insulated panels that attach to the roof and the first and second sidewalls 116, 118. In one example, the TCE unit 100 may have a length (i.e., extending between the first and second side walls 116, 118) of approximately 9 feet, a height (i.e., extending between the ground surface 126 and the roof 112) of approximately 9 feet, and a width (i.e., measured between the opening 108 and the back wall 104) of approximately 5 feet. However, in other exemplary TCE units 100, these dimensions may vary. For example, the side walls 116, 118 and/or back wall 104 may include a plurality connected insulated panels depending on the desired size and shape of the TCE unit 100. In other words, the TCE unit 100 may be customized. The panels may be connected to each other by a hybrid insulated frame, such as the hybrid frames disclosed in U.S. Pat. No. 10,246,873, filed Nov. 16, 2017, titled "Insulated Structural Members for Insulated Panels and a Method of Making Same," U.S. application Ser. No. 16/663,910, filed on Oct. 25, 2019, titled "Method of Manufacturing Hybrid Insulation Panel," and U.S. application Ser. No. 16/582,147, filed Sep. 25, 2019, titled "Hybrid Insulating Panel, Frame, and Enclosure," which are hereby incorporated by reference. In other examples, the frames may be wood, metal, composite, foam, or a combination of materials.

Figure 2:
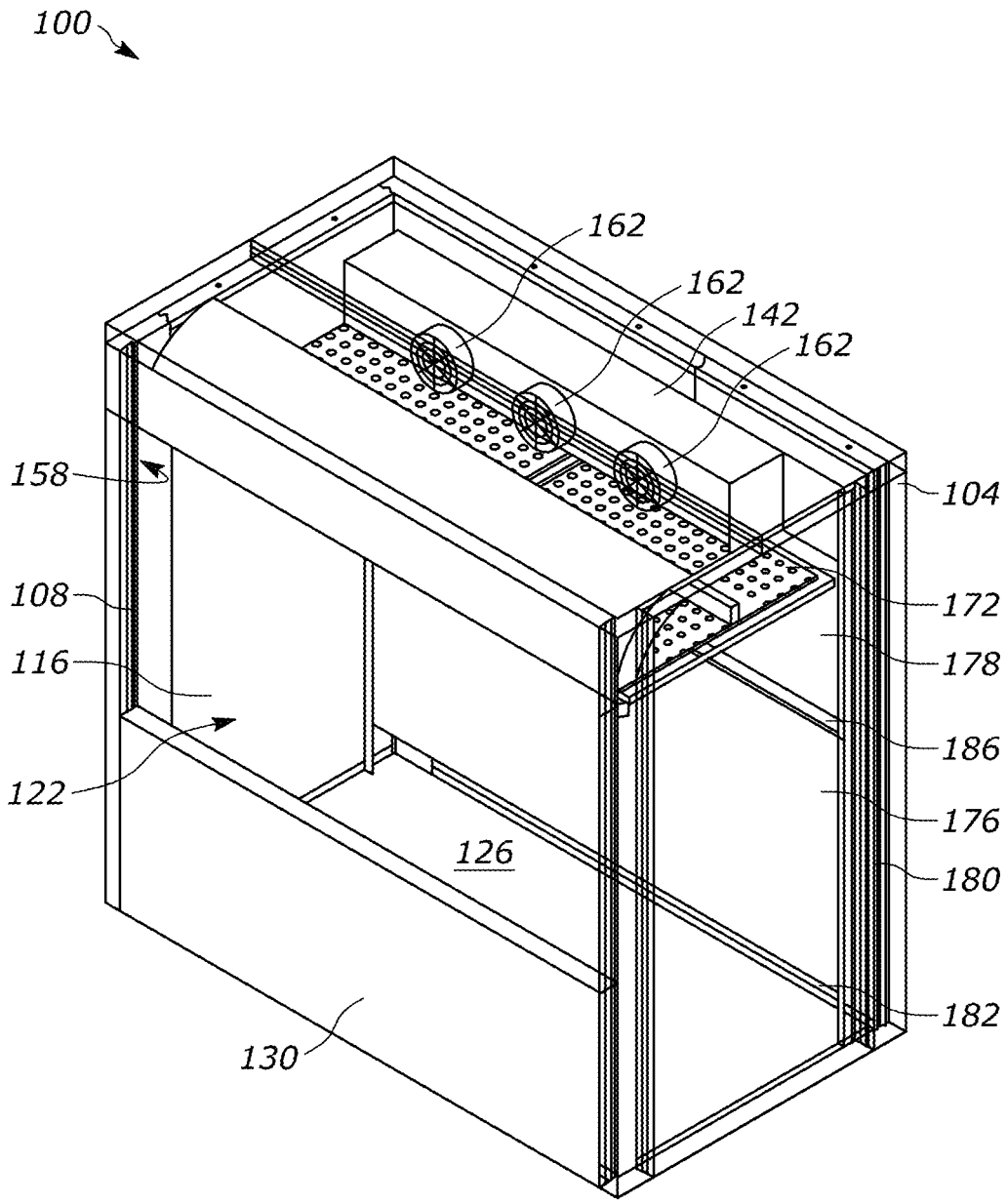
FIG. 2 is a perspective view of the TCE unit of FIG. 1, illustrating an interior of the TCE unit with a roof and side panels hidden from view.

Turning now to FIG. 2, a partial TCE unit 100 of FIG. 1 is illustrated. In FIG. 2, a portion of an air curtain assembly 158, such as the air curtain assemblies described in U.S. Appl. No. 63/117,677, filed on Nov. 24, 2020, titled "Accessible Cooling Environment," which is hereby incorporated by reference. In operation, air is circulated through the TCE unit 100 by the blower 146 and/or the fans 162 of the evaporator 142. It should be noted that the blower 146 and/or the fans 162 may be operated in both the on-cycle and the off-cycle of the compressor. To this end, to perform an air-defrost cycle, the control system 154 operates the blower 146 and/or the fans 162 during an off-cycle of the compressor 139 to distribute uncooled air throughout the interior space 122. This causes warmer air to circulate through the evaporator 142 and/or the coils thereof to assist in the defrost process.

As shown in FIG. 2, a first wall plate 176 is spaced from the ground 126 and spaced from a second wall plate 178, thereby forming a first opening or slot 182 with the ground 126 and a second opening or slot 186 with the second wall plate 178. Air flows through either the first or second openings 182, 186 into the duct 180. The ceiling plate 172 allows airflow into the product space of the interior space 122 of the TCE unit 100. In operation, the air curtain assembly 158 limits air intrusion into the interior space 122 of the TCE unit 100 and facilitates cooling of the product in the interior space 122. The fans 162 of the evaporator 142 and the blower 146 on the roof 112 direct air towards the opening 108 to distribute cool air evenly throughout the interior space 122. The distributed air then circulates through the back duct 180 and either into the duct 150 and the blower 146 or into an input of the evaporator 142.

Figure 3:
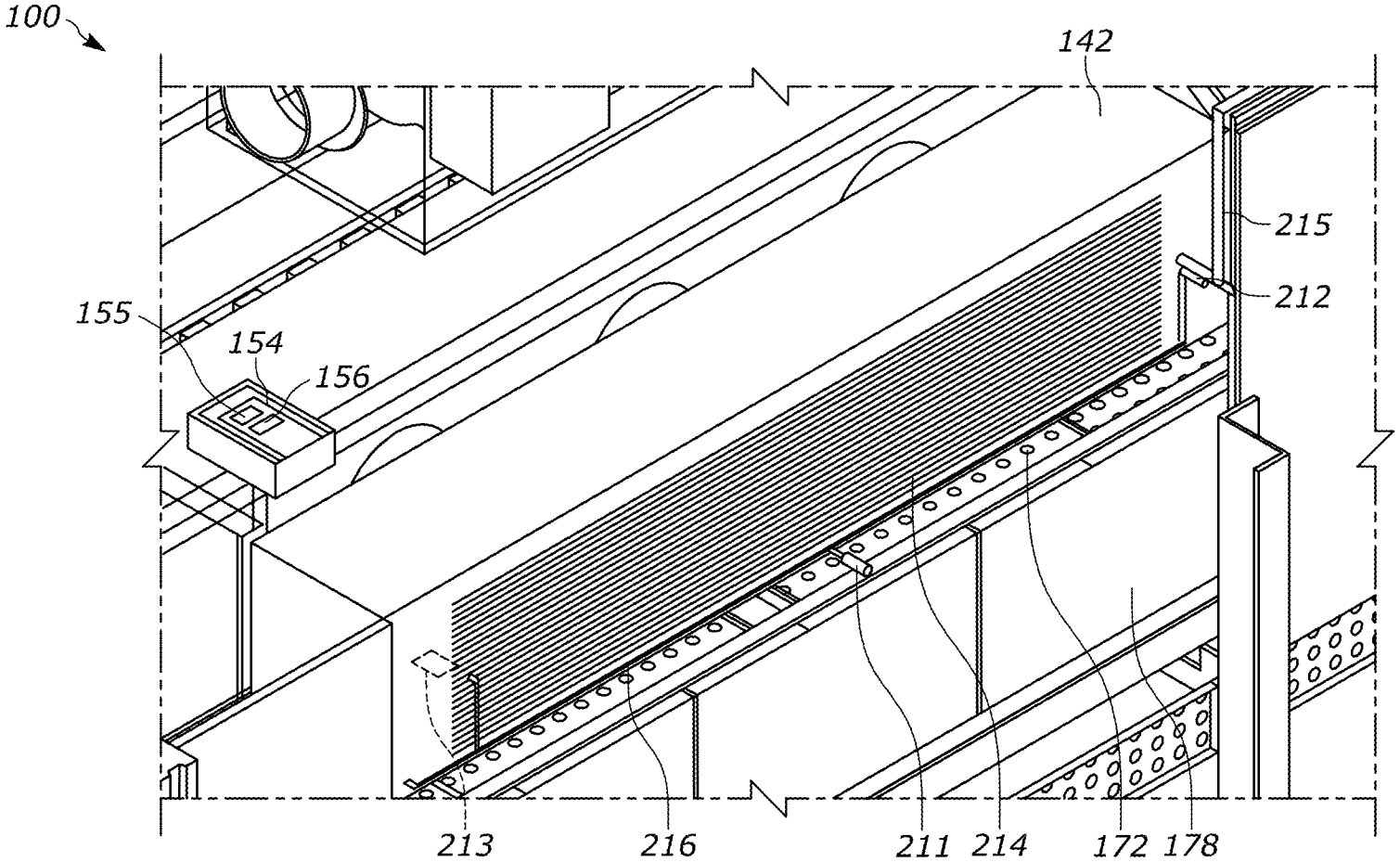
FIG. 3 is a partial, back perspective view of the TCE unit of FIG. 1, illustrating a control system.

In FIGS. 1 and 3, the control system 154 is illustrated in more detail. The control system 154 is disposed on the roof 112 (hidden in FIG. 3) and/or in the evaporator 142 of the TCE unit 100 and is coupled to control a variety of functions of the air curtain assembly 158 and/or the refrigeration system 134. For example, the control system 154 operates the refrigeration system 134 by controlling the compressor 139 to perform on-cycles and off-cycles during which a defrost cycle is also performed. In some embodiments, the control system 154 also includes an assisted defrost system. Accordingly, the control system 154 may also perform a secondary defrost cycle during which the control system engages the assisted defrost system to apply additional heat to coils of the evaporator 142. In some embodiments, the assisted defrost system is an electrical defrost system via which electrical current is routed through a wire that causes heat to be emitted therefrom. In other embodiments, the assisted defrost system is a hot gas defrost system in which the refrigerant line is reversed such that the refrigerant is warmer when passing through the evaporator 142. It should be appreciated that the assisted defrost systems draw additional power when engaged. Accordingly, techniques disclosed herein relate to minimizing the number of secondary defrost cycles performed by the control system 154 to reduce the energy consumption by the TCE unit 100 while still maintaining efficient operation of the evaporator 142.

The control system 154 also includes at least one sensor coupled to the evaporator 142 and configured to capture sensor data associated with a temperature at an input 214 and/or inside the evaporator 142, such as on a coil of the evaporator 142. The control system 154 may also include at least one sensor disposed in the interior space 122 to capture sensor data associated with a temperature of the interior space 122.

As discussed in greater detail with respect to FIG. 5, in an example, the control system 154 may switch the compressor 139 from the on-state to the off-state based on receiving sensor data indicating that temperature of the interior space 122 has reached a first user-programmable temperature set point. The first temperature set point may be, for instance, an ideal temperature set point for the product being cooled (e.g., 36° F.).

However, in some examples, based on external conditions, such as humidity levels associated with the temperature controlled environment, it may be difficult or impossible to cool the interior space 122 to the first temperature set point. Thus, in some examples, the control system 154 may also be configured to shift to a second, higher, user-programmable temperature set point after a user-programmable threshold period of time (e.g., 35 minutes) passes without the temperature of the interior space 122 reaching the first temperature set point. The second temperature set point may be an acceptable but less ideal temperature for the product being cooled (e.g., 40° F.). Thus, if the threshold period of time has passed since the on-state of the compressor was initiated, and the sensor data indicates that the interior space 122 has not reached the first temperature set point, the control system 154 may shift to the second temperature set point. After this point, if the second temperature set point is reached, the control system 154 may switch the compressor 139 from the on-state to the off-state despite the first temperature set point not having been reached during the compressor cycle.

In contrast, conventional systems typically use only a single temperature set point even in high humidity environments, and cannot distinguish between, for instance, a temperature that is within a few degrees above the temperature set point and a temperature that is much higher than the temperature set point. That is, in a conventional system with a temperature set point of 36° F., a temperature of 40° F. is treated no differently than a temperature of 60° F., as both are above the temperature set point, and the compressor will continue running indefinitely until the single temperature set point is reached, even if that takes hours or never occurs. Advantageously, using the techniques provided herein, the implementation of the second temperature set point allows the control system 154 better maintain the temperature of the refrigerated air and the products, particularly in high humidity conditions. That is, as discussed above, in high humidity conditions, the time needed to cool the interior space 122 may increase due to increased refrigeration load, and during this time, ice may build up on the evaporator, further increasing the time needed to cool the interior space 122, which leads to more ice buildup, which in turn leads to increased time required to cool the interior space 122, etc. Consequently, in high humidity conditions, it may be important to end the on-cycle of the compressor 139 once the second temperature set point is reached rather than running the compressor 139 indefinitely in an attempt to reach the first temperature set point, i.e., so that defrosting can occur to prevent the buildup of ice and frost on the evaporator 142.

The control system 154 includes one or more processors 155 and a memory 156 that is communicatively coupled to the one or more processors 155 and stores executable instructions to operate the refrigeration system 134. The executable instructions cause the one or more processors 155 to receive the sensor data captured by the one or more sensors, analyze the sensor data to identify a status or condition associated with the evaporator 142, and send a signal to the evaporator 142 to heat or cool based on the status or condition identified.

In one example shown in FIG. 3, the control system 154 includes a first sensor 211, a second sensor 212, a third sensor 213 and a conduit 216, or temperature wire, connecting the first, second, and third sensors 211, 212, and 213 to the control system 154. The temperature wire 216 runs through the front (i.e., the outlet side) of the evaporator 142 and through the back of the evaporator 142 (i.e., the inlet side). The first sensor 211 is in the return airstream before entering the coil at an input 214 of the evaporator 142, the second sensor 212 is disposed on a suction line 215 connecting the evaporator 142 to the condenser unit 138, and the third sensor 213 is disposed inside of the evaporator 142 and between the coils (i.e., where the ice clears last) of the evaporator 142. So configured, the three temperature sensors 211, 212, 213 relay information about the temperatures to the control system 154 at various locations on or near the evaporator 142 to accurately determine which defrost cycle should be performed and to monitor the evaporator 142 during the defrost and cooling cycles.

Figure 4:
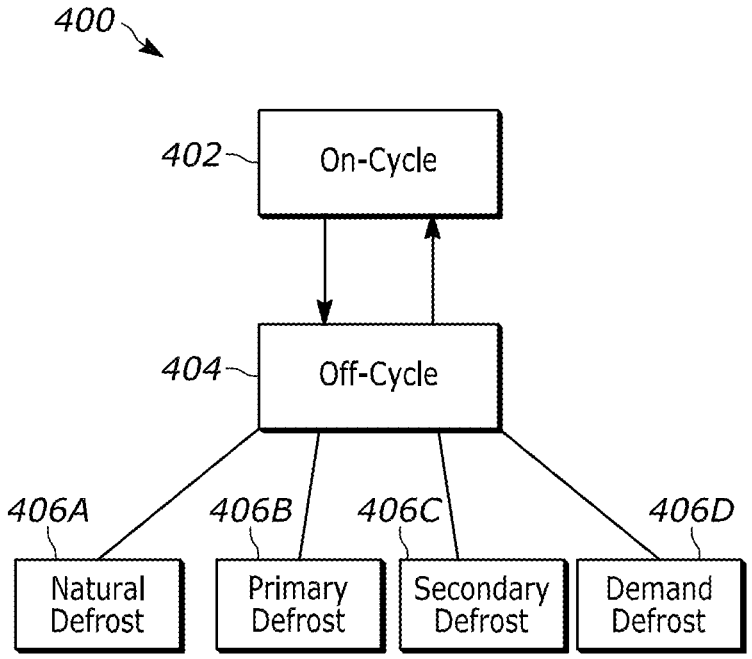
FIG. 4 is a flow diagram representative of a control loop implemented by a control system of the TCE unit of FIG. 1.

In FIG. 4, a flow diagram 400 representative of a control loop implemented by the control system 154 of the TCE unit 100 is shown. The control system 154 alternates between controlling the compressor 139 to operate in an on-state during on-cycles 402 and controlling the compressor 139 to operate in an off-state during off-cycles 404. Generally speaking, the control system 154 cools the interior space 122 during the on-cycle 402 and allows the temperature of the interior space 122 to rise during the off-cycle 404 to defrost frost and/or ice that may have formed on a coil of the evaporator 142.

As will be described in more detail below, during the on-cycle 402, the control system 154 operates the compressor 139 in the on-state until a threshold condition is reached. At this point, the control system 154 begins controlling the components of the TCE unit 100 to perform an off-cycle 404 in accordance with the off-cycle techniques described below. After the off-cycle 404 concludes, the control system 154 then executes another cycle of the on-cycle 402. During the off-cycle 404, the control system 154 is configured to perform a defrost cycle 406. For example, the control system 154 may perform a natural defrost cycle 406A, a primary defrost cycle 406B, a secondary defrost cycle 406C, or a demand defrost cycle 406D.

At the start of the off-cycle 404, the control system 154 may obtain an indication from the memory 156 to determine which defrost cycle 406 to perform. In some embodiments, the memory 156 stores a flag associated with each defrost cycle type. In these embodiments, the control system 154 may perform the defrost cycle corresponding to the defrost cycle type associated with a flag set to an on-state. For instance, if the primary defrost cycle flag is set to an on-state, the control system 154 may control the components of the TCE unit 100 to execute the primary defrost cycle 406B. Additionally, in these embodiments, the control system 154 may rank or prioritize the different defrost cycle types such that if multiple flags are set to an on-state, the control system 154 executes the defrost cycle 406 corresponding to the highest rank or priority of the defrost cycle types having flags set to an on-state.

In other embodiments, the memory 156 corresponds the defrost cycle types to a particular value. In these embodiments, the control system 154 may perform the defrost cycle type corresponding to the value of a particular parameter stored at the memory 156. For instance, if the control system 154 associates the primary defrost cycle type with a value of "primary" or "01", the control system 154 may control the components of the TCE unit 100 to execute the primary defrost cycle 406B when the memory 156 indicates "primary" or "01" as the defrost cycle type setting.

As will be described below, the control system 154 may be configured to set the flag and/or parameter values while executing the defrost cycle 406. Additionally, the control system 154 may be configured to receive a user-provided input to set the flag and/or parameter value to perform the defrost cycle type indicated by the user. For example, the TCE unit 100 may be associated with a remote programming interface (e.g., an application executing on a client device) via which an operator of the TCE unit 100 can control various parameters and/or settings of the control system 154. As another example, the TCE unit 100 may include a display configured to present one or more user interfaces via which the operator of the TCE unit 100 can control the parameters and/or settings of the control system 154. In addition to setting the indication of a defrost cycle type to utilize during the next off-cycle 404, the user interfaces may be configured to enable the user to program a timer or a scheduler to set the indication of a defrost cycle type at a predetermined time in the future. It should be appreciated that the user programmed timer or scheduler based defrost cycles may not interfere with the automatic control of the defrost cycle type described elsewhere herein. Said another way, disclosed techniques enable users to operate the TCE unit 100 in accordance with both user-programmed schedules and automatic controls simultaneously.

As described above, during the on-cycle 402, the control system 154 may operate the compressor 139 in the on-state until one of several possible threshold conditions are reached. Referring now to FIG. 5, generally speaking, operating the compressor 139 in the on-state begins with starting (502) a compressor cycle. When the compressor cycle starts, a compressor runtime clock may also start (504) to track the amount of time that the compressor has been on in the current cycle. As one example, a possible threshold condition that may trigger the ending of the compressor cycle is a maximum compressor runtime being reached (506). For example, this maximum compressor runtime may be set based on input from a user, e.g., a selection of an amount of time in one minute increments from 0 to 300. For instance, an example maximum compressor runtime may be 60 minutes. Accordingly, if the compressor runtime clock detects that 60 minutes has passed since the start of the compressor cycle, the control system 154 may end (508) the compressor cycle (i.e., in order to begin the off-cycle 404).

Another possible threshold condition that may trigger the ending of the compressor cycle is a first temperature set point being reached (510). As discussed above, the control system 154 may include at least one sensor disposed in the interior space 122 to capture sensor data associated with a temperature of the interior space 122. The first temperature set point may be set based on input from a user, e.g., a selection of a temperature in 0.1° F. increments from −50° F. to 100° F. For instance, the first temperature set point may be 36° F. Specifically, when the sensor disposed in the interior space 122 detects (510) a temperature at or below the first temperature set point, and a first minimum compressor runtime is reached (512), the control system 154 may end (508) the compressor cycle. The first minimum compressor runtime may be set based on input from a user, e.g., a selection of an amount of time in one minute increments from 0 to 300. For instance, an example first minimum compressor runtime may be 15 minutes.

If the first temperature set point is not reached after a threshold amount of time for shifting the temperature set point (514), another possible threshold condition that may trigger the ending of the compressor cycle is a second temperature set point being reached (516). The threshold amount of time for shifting the temperature set point may be set based on input from a user, e.g., a selection of an amount of time in one minute increments from 0 to 300. For instance, an example threshold amount of time may be 35 minutes. Like the first temperature set point, the second temperature set point may be set based on input from a user, e.g., a selection of a temperature in 0.1° F. increments from −50° F. to 100° F. Generally speaking, however, the second temperature set point is higher than the first temperature set point. For instance, the first temperature set point may be 40°

F. Specifically, when the sensor disposed in the interior space 122 detects (516) a temperature at or below the second temperature set point after the threshold amount of time for shifting the temperature set point has passed (514), and a first minimum compressor runtime is reached (512), the control system 154 may end (508) the compressor cycle. As a note, the threshold amount of time is generally longer than the first minimum compressor runtime, so checking that the first minimum compressor runtime has been reached (512) may not be necessary given that the threshold period of time for shifting the temperature set point has passed (514).

Still another possible threshold condition that may trigger the ending of the compressor cycle is a minimum temperature being reached (518). The minimum temperature may be a minimum allowable temperature for the temperature controlled environment, and may be set based on input from a user, e.g., a selection of a temperature in 0.1° F. increments from −50° F. to 100° F. For instance, the minimum temperature may be 33° F. Specifically, when the sensor disposed in the interior space 122 detects (518) a temperature at or below the minimum temperature, and a second minimum compressor runtime is reached (520), the control system 154 may end (508) the compressor cycle. The second minimum compressor runtime may be a "bare minimum" runtime for the compressor, and may be set based on input from a user, e.g., a selection of an amount of time in one minute increments from 0 to 300. For instance, an example second minimum compressor runtime may be 5 minutes.

In any case, after the compressor cycle is ended (508), a compressor off time clock may also start (522) to track the amount of time that the compressor has been off since the ending of the most recent cycle, e.g., as the natural defrost cycle 406A occurs. Generally speaking, the control system 154 may operate the compressor 139 in the off-state until one of several possible threshold conditions are reached. For instance, as shown at FIG. 5, in one example, the control system 154 may operate the compressor 139 in the off-state until a maximum compressor off time has been reached (524), at which point the control system 154 may start (502) the compressor, beginning a new cycle. The maximum compressor off time may be set based on input from a user, e.g., a selection of an amount of time in one minute increments from 0 to 300. For instance, an example maximum compressor off time may be 10 minutes. Time spent in any defrost cycles may be included in the determination in the amount of time that the compressor has been off since the ending of the most recent cycle. Furthermore, in some examples, the control system 154 may not start the compressor until both the maximum compressor off time has been reached and any defrost cycles have ended.

During the on-cycle 402, the control system 154 may also analyze sensor data to determine whether a particular defrost cycle 406 should be performed during the next off-cycle 404. For example, the control system 154 may analyze performance of evaporator 142 by analyzing the exhaust air temperature of the evaporator 142 (e.g., via a sensor disposed in front of the fans 162) and a return airstream temperature into the evaporator 142 (e.g., via the sensor 211). In some embodiments, performance is determined by analyzing a temperature difference between the exhaust air temperature and the return airstream temperature. In other embodiments, the performance is determined by performing other analyses of the exhaust air temperature and/or the return airstream temperature. Additionally or alternatively, the control system 154 may analyze other temperature values generated by other temperature sensors of the TCE unit 100. If the performance has fallen below a threshold percentage (e.g., 80%, 85%, 90%, or a user-programmed percentage) as compared to normal and/or baseline operation, then the control system 154 may set the defrost type indication in the memory 156 to indicate that the primary defrost cycle 406B should be executed during the next off-cycle 404. Of course, the control system 154 may also be configured to compare other operating conditions of the components of the TCE unit 100 to respective thresholds to determine a need to execute a particular defrost cycle 406.

Turning now to improvements to off-cycle operation, the control system 154 may be configured to perform different defrost cycles types based upon an indication of defrost cycle type stored in the memory 156. Accordingly, the following describes the control techniques implemented by the control system 154 of the TCE unit 100 to perform the different defrost cycle types.

Figure 6A:
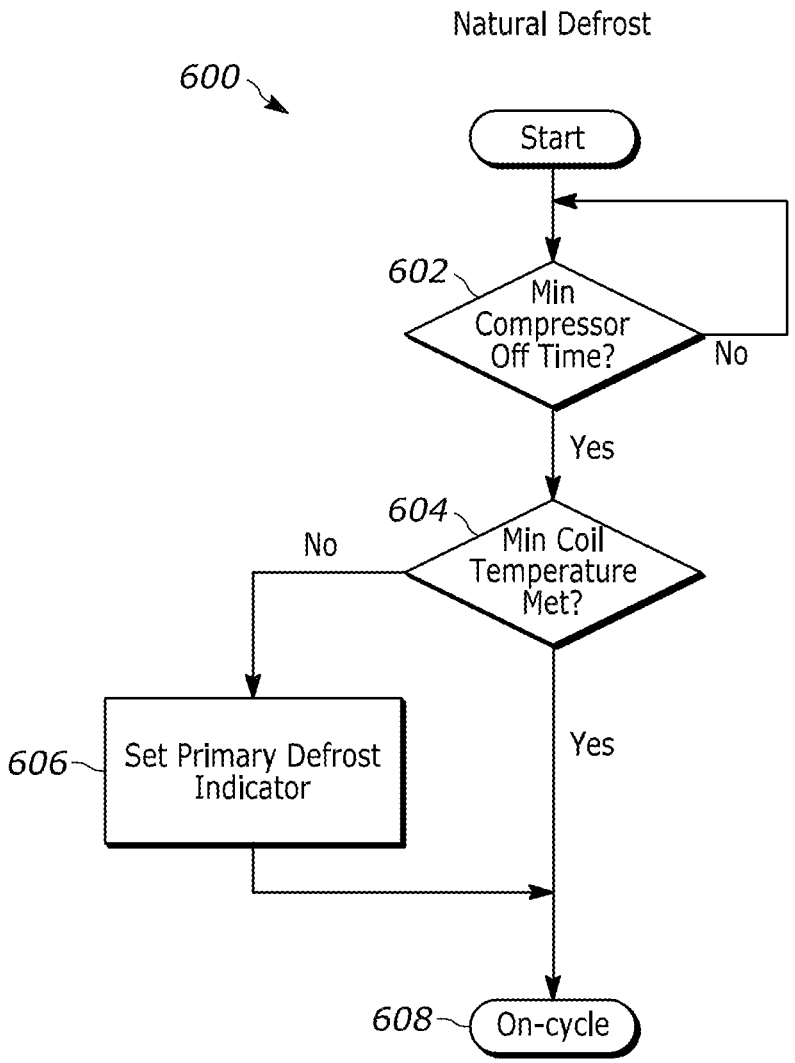
FIG. 6A is a flow diagram indicating the control logic for executing the natural defrost cycle 406A of FIG. 4 in accordance with the teachings of the present disclosure.

Starting with FIG. 6A, illustrated is an example flow diagram 600 indicating the control logic for executing the natural defrost cycle 406A of FIG. 4. Generally speaking, during the primary defrost cycle 406B, the control system 154 enables lower power defrost systems, such as an air defrost system. For example, the air defrost system may be the blower 146 and/or the fans 162 of the evaporator 142. Because the compressor 139 is operated in an off-state during the off-cycle 404, the air circulated by the air defrost system is generally warmer than the temperature of the coil of the evaporator 142. When executing the natural defrost cycle 406A, the control system 154 executes a control cycle based on an off-time of the compressor 139. Thus, the natural defrost cycle 406A is typically shorter than the other defrost cycle types 406 and requires less energy to perform. Accordingly, to reduce power usage of the TCE unit 100, the natural defrost cycle 406A may be the default defrost cycle type executed by the control system 154 if no flags are set to an on-state and/or there are no other indications of a defrost cycle type indicated in the memory 156.

The natural defrost cycle 406A may begin when the control system 154 switches the compressor 139 to operate in an off-state while ensuring that the air defrost system operates in an on-state. As described above, frequent switching of the compressor 139 between on- and off-states increases the wear and tear on the compressor 139, leading to more frequent maintenance requirements. Accordingly, at decision 602, the control system 154 determines whether a minimum compressor off time as been achieved. For example, the minimum compressor off time may be 3 minutes, 5 minutes, 7 minutes, 10 minutes, 15 minutes, or a user-programmed time value.

After the minimum compressor off time is reached ("Yes"), the control system 154 then obtains sensor data to determine a temperature of the coil of the evaporator 142. For example, the sensor 213 may provide an accurate measurement of the temperature of the coil of the evaporator 142. At decision 604, the control system 154 compares the obtained temperature value to a temperature threshold to determine whether the coil of the evaporator 142 has warmed to at least a threshold temperature indicative of proper performance of the evaporator 142 in a subsequent on-cycle. For example, the temperature threshold may be 37.0° F., 38.0° F., 39.5° F., or a user-programmed temperature value.

If the sensed temperature of the coil of the evaporator 142 is above the threshold temperature ("Yes"), then the control system 154 terminates the off-cycle 404 and controls (608) the components of the TCE unit 100 to execute another on-cycle 402. On the other hand, if the sensed temperature is below the threshold temperature ("No"), the coil of the evaporator 142 has not warmed to a preferred operating temperature. Accordingly, the control system 154 sets (606) the indication at the memory 156 such that the primary defrost cycle 406B is executed during the next off-cycle 404. In embodiments where the evaporator 142 includes multiple coils and corresponding temperature sensors, then the control system 154 may set the indication at the memory 156 to indicate the primary defrost cycle type if any one of the sensed temperatures is below the threshold temperature. It should be appreciated that regardless of the outcome of the decision 604, the control system 154 executes the subsequent on-cycle 402 after the expiration of the minimum compressor off time.

Figure 6B:
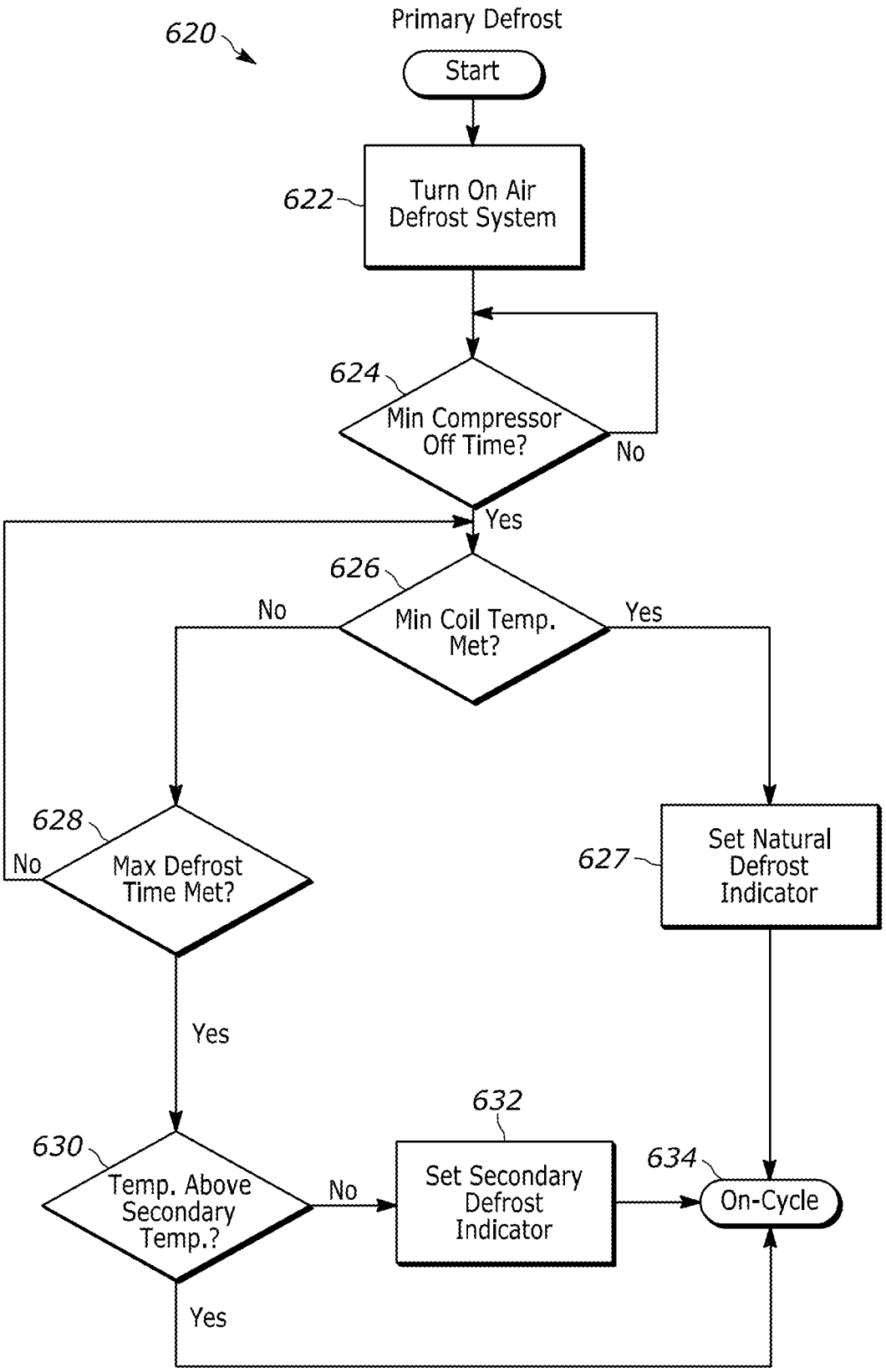
FIG. 6B is a flow diagram indicating the control logic for executing the primary defrost cycle 406B of FIG. 4 in accordance with the teachings of the present disclosure.

Turning to FIG. 6B, illustrated is an example flow diagram 620 indicating the control logic for executing the primary defrost cycle 406B of FIG. 4. Similar to the natural defrost cycle 406A, during the primary defrost cycle 406B, the control system 154 enables lower power defrost systems, such as an air defrost system. Unlike the natural defrost cycle 406A, the control system 154 includes a coil temperature set point value that controls the duration of the primary defrost cycle 406B. Thus, the primary defrost cycle 406B may run for a longer duration than the natural defrost cycle 406A if the set point coil temperature has not been reached upon expiration of the minimum compressor off time. Nonetheless, the air defrost system generally draws less power than a secondary defrost system. Accordingly, to reduce power usage of the TCE unit 100, the control system 154 may execute the primary defrost cycle 406B before executing the secondary defrost cycle 406C.

The primary defrost cycle 406B may begin when the control system 154 switches the compressor 139 to operate in an off-state and controls (622) the air defrost system to operate in an on-state. If the air defrost system includes components that operate in an on-state during the on-cycle 402, the control system 154 may control the compressor 139 to switch to an off-state without similarly controlling the air defrost system to switch to an off-state.

At decision 624, the control system 154 determines whether a minimum compressor off time as been achieved. For example, the minimum compressor off time may be 3 minutes, 5 minutes, 10 minute, 15 minutes, or a user-programmed time value. After the minimum compressor off time is reached ("Yes"), the control system 154 then obtains sensor data to determine a temperature of the coil of the evaporator 142. For example, the control system 154 may obtain the temperature data in a manner described above with respect to the natural defrost cycle 406A. At decision 626, the control system 154 compares the obtained temperature value to a temperature threshold to determine whether the coil of the evaporator 142 has warmed to at least a threshold temperature indicative of proper performance of the evaporator 142 in a subsequent on-cycle. For example, the temperature threshold may be 37.0° F., 38.0° F., 39.5° F., or a user-programmed temperature value. Accordingly, in some embodiments, the minimum temperature threshold of the primary defrost cycle 406B is the same as the minimum temperature threshold of the natural defrost cycle 406A. In other embodiments, the minimum temperature threshold of the primary defrost cycle 406B is higher or lower than the minimum temperature threshold of the natural defrost cycle 406A.

To avoid permitting the temperature of the interior space 122 to rise to the point of potentially impacting item quality for items in the interior space 122, the control system 154 may be programmed with a maximum primary defrost time setting. For example, the maximum primary defrost time may be 15 minutes, 20 minutes, 25 minutes, or a user-programmed value. Accordingly, if the sensed temperature of the coil of the evaporator 142 is below the minimum temperature threshold ("No", decision 626), and the maximum primary defrost time has not been reached ("No", decision 628), the control system 154 may continue executing the primary defrost systems and obtaining additional temperature data indicative of the temperature of the coil of the evaporator 142.

If the control system 154 senses that the temperature of the coil of the evaporator 142 is above the minimum temperature threshold before the maximum primary defrost time is reached ("Yes", decision 626), then it is indicative that the primary defrost cycle 406B was able to properly defrost the coil of the evaporator 142. Accordingly, the control system 154 may set (627) the indication of defrost cycle type in the memory 156 to indicate the natural defrost cycle 406A and control (634) the components of the TCE unit 100 to execute another on-cycle 402. As a result, the air defrost system is not operated in an on-state during the next off-cycle 404, thereby reducing the power consumption of the TCE unit 100.

On the other hand, if the temperature of the coil of the evaporator 142 never rises above the minimum temperature threshold before the maximum defrost time is met ("No", decision 628), at decision 630, the control system 154 compares a current temperature of the coil of the evaporator 142 to a secondary temperature threshold. The secondary temperature threshold may be set to a temperature value that indicates whether or not the air defrost system was able to make sufficient progress in defrosting the coil of the evaporator 142. Accordingly, the secondary temperature threshold is generally lower than minimum temperature threshold of the primary defrost cycle 406B. For example, the secondary temperature threshold may be 33.5° F., 34.0° F., 34.5° F., or a user-programmed temperature value.

If the control system 154 determines that the temperature of the coil of the evaporator 142 is above the secondary temperature threshold ("Yes"), it may be inferred that the air defrost system is able to sufficiently defrost the coil of the evaporator 142 (although further operation of the air defrost system is still needed to defrost the coil of the evaporator to a preferred level). Accordingly, the control system 154 may control (634) the components of the TCE unit 100 to execute another on-cycle 402 without changing the indication of the defrost cycle type in the memory 156. On the other hand, if the control system 154 determines that the temperature of the coil of the evaporator 142 is below the secondary temperature threshold ("No"), it may be inferred that the air defrost system is unable to sufficiently defrost the coil of the evaporator 142. Accordingly, the control system 154 may set (632) the indication of defrost cycle type in the memory 156 to indicate the secondary defrost cycle 406C and control (634) the components of the TCE unit 100 to execute another on-cycle 402. As a result, the control system 154 executes the secondary defrost cycle 406C during the next off-cycle 404. It should be appreciated that if the evaporator 142 includes multiple coils and corresponding temperature sensors, then the control system 154 may set the indication at the memory 156 to indicate the secondary defrost cycle type if any one of the sensed temperatures is below the threshold temperature.

Figure 6C:
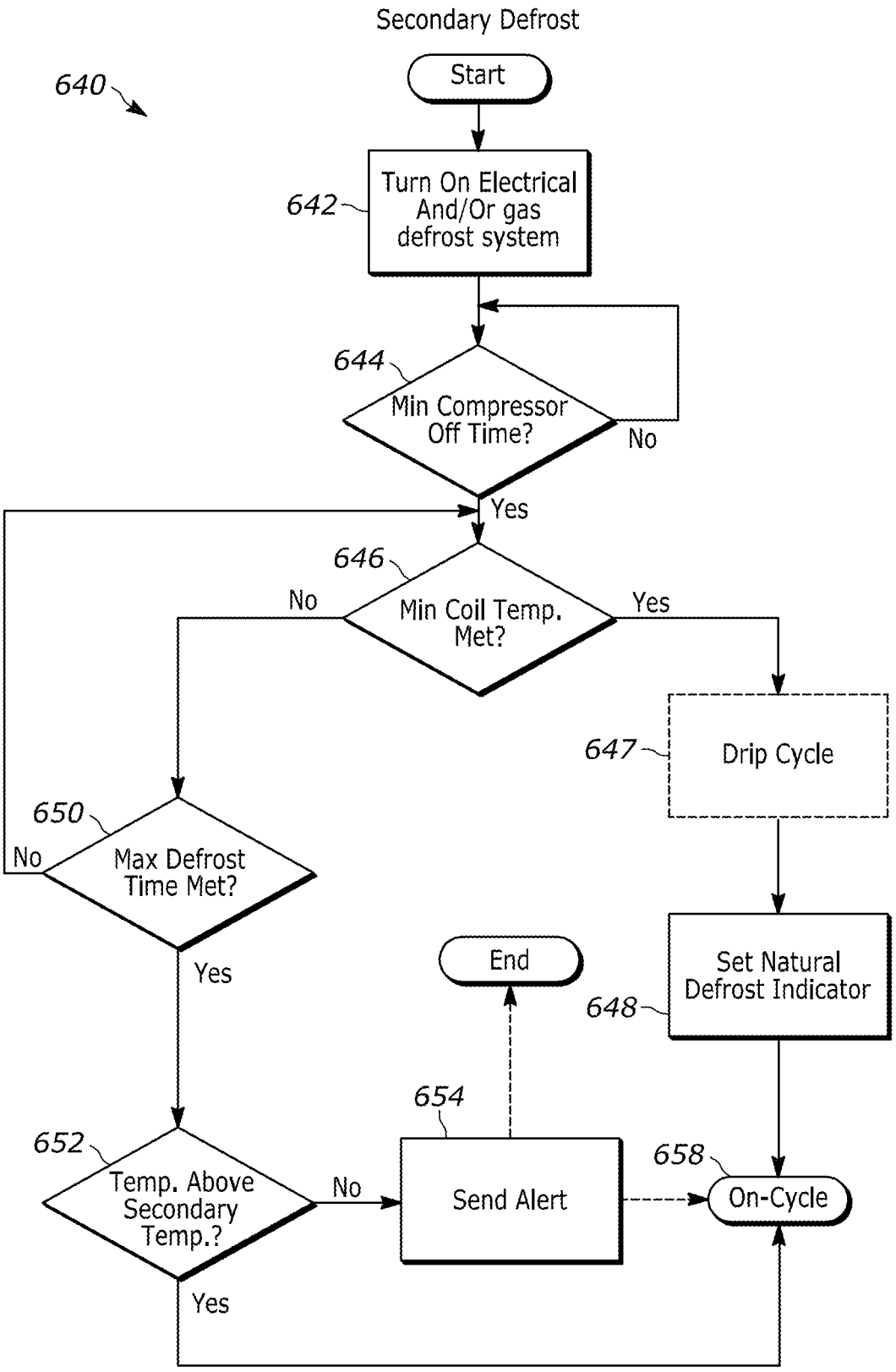
FIG. 6C is a flow diagram indicating the control logic for executing the secondary defrost cycle 406C of FIG. 4 in accordance with the teachings of the present disclosure.

Turning to FIG. 6C, illustrated is an example flow diagram 640 indicating the control logic for executing the secondary defrost cycle 406C of FIG. 4. Generally speaking, during the secondary defrost cycle 406C, the control system 154 enables higher power, secondary defrost systems, such as a gas defrost system and/or an electrical defrost system. It should be appreciated that because of the increased power demand in executing the secondary defrost cycle 406C, the control system 154 generally only executes the secondary defrost cycle 406C during the off-cycle 404 when other defrost systems were unable to sufficiently defrost the coil of the evaporator 142.

The secondary defrost cycle 406C may begin when the control system 154 switches the compressor 139 to operate in an off-state and controls (642) the secondary defrost system to operate in an on-state. The control system 154 proceeds through decisions 644, 646, and 650 in a similar manner as described with respect to the decisions 624, 626, and 628 of the primary defrost cycle 406B. It should be appreciated while the control system 154 generally performs the same logical steps, the control system 154 may be configured with different values for the minimum coil temperature of decision 646 and the maximum defrost time of decision 650 may vary than those configured to execute the decision 626 and 626 of the primary defrost cycle 406B. For example, the maximum secondary defrost time may be 30 minutes, whereas the maximum primary defrost time is only 20 minutes. To this end, if the secondary defrost system is unable to sufficiently defrost the coil of the evaporator 142, there may be a serious defect in one or more components of the TCE unit 100. Accordingly, by having a longer maximum secondary defrost time, the control system 154 is provided additional opportunity to self-correct before initiating more serious remedial actions.

If the control system 154 senses that the temperature of the coil of the evaporator 142 is above the minimum temperature threshold before the maximum secondary defrost time is reached ("Yes", decision 646), then it is indicative that the secondary defrost cycle 406B was able to properly defrost the coil of the evaporator 142. Accordingly, the control system 154 may set (648) the indication of defrost cycle type in the memory 156 to indicate the natural defrost cycle 406A and control (658) the components of the TCE unit 100 to execute another on-cycle 402. As a result, the secondary defrost system is not operated in an on-state during the next off-cycle 404, thereby reducing the power consumption of the TCE unit 100. Because the secondary defrost cycle 406C is generally executed when there is significant condensation on the coil of the evaporator 142, the control system 154 may execute (647) a drip cycle to collect and/or evaporate condensation that has melted off the coil of the evaporator 142 prior to executing the subsequent on-cycle 402.

On the other hand, if the temperature of the coil of the evaporator 142 never rises above the minimum temperature threshold before the maximum defrost time is met ("No", decision 650), at decision 652, the control system 154 compares a current temperature of the coil of the evaporator 142 to a secondary temperature threshold. Accordingly, the control system 154 may perform similar techniques to those described with respect to the decision 630 of the primary defrost cycle 406B.

If the control system 154 determines that the temperature of the coil of the evaporator 142 is above the secondary temperature threshold ("Yes"), it may be inferred that the secondary defrost system is able to sufficiently defrost the coil of the evaporator 142 (although further operation of the secondary defrost system is still needed to defrost the coil of the evaporator to a preferred level). Accordingly, the control system 154 may control (658) the components of the TCE unit 100 to execute another on-cycle 402 without changing the indication of the defrost cycle type in the memory 156.

On the other hand, if the control system 154 determines that the temperature of the coil of the evaporator 142 is below the secondary temperature threshold ("No"), it may be inferred that the secondary defrost system is also unable to sufficiently defrost the coil of the evaporator 142. Thus, neither the primary defrost cycle 406B or the secondary defrost cycle 406C is able to restore the temperature of the coil of the evaporator 142 to a preferred operating level. Accordingly, the control system 154 may send (654) an alert to an operator of the TCE unit 100. For example, the alert may be an indication in an application executing on a client device, a text and/or push message sent to a client device, an audio alert generated by an output device of the TCE unit 100, or other alert techniques known in the art. In some embodiments, to prevent possible damage to components of the TCE unit 100, the control system 154 may terminate the control loop 400 and not execute another on-cycle 402 until a maintenance check has been completed. In other embodiments, to prevent damage to items located in the interior space 122, the control system 154 may continue to operate a subsequent on-cycle 402. Accordingly, the memory 156 may store an indication of a preferred action for the control system 154 when the secondary defrost cycle 406C is unable to properly defrost the coil of the evaporator 142.

Figure 6D:
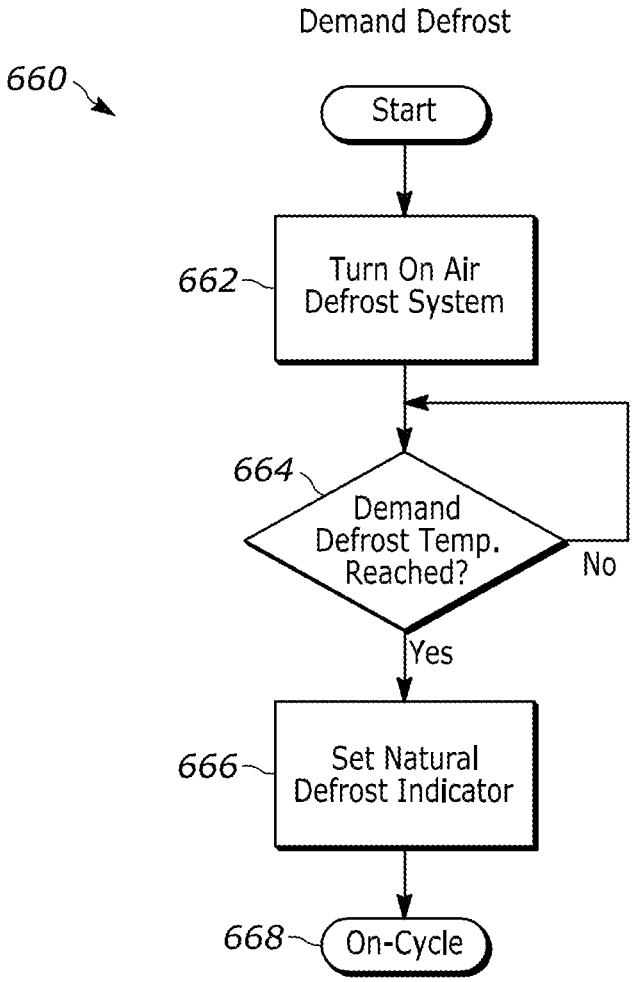
FIG. 6D is a flow diagram indicating the control logic for executing the demand defrost cycle 406D of FIG. 4 in accordance with the teachings of the present disclosure.

Turning to FIG. 6D, illustrated is an example flow diagram 660 indicating the control logic for executing the demand defrost cycle 406D of FIG. 4. Generally speaking, the demand defrost cycle 406D is executed to fully defrost the interior space. For example, in some scenarios, the sensors described above may be misplaced such that the temperature data is not indicative of a coldest location in the TCE unit 100. As a result, frost and/or ice may be building up without being sensed by the control system 154. Thus, the operator of the TCE unit 100 may occasionally execute the demand defrost cycle 406D to ensure any undetected build of frost and/or ice is addressed. Due to its duration, the demand defrost cycle 406D is often scheduled to be performed during predetermined time windows when items are unlikely to be located in the interior space 122.

The demand defrost cycle 406B may begin when the control system 154 switches the compressor 139 to operate in an off-state and controls (662) the air defrost system to operate in an on-state. It should be appreciated that the flow diagram 660 indicates that the air defrost system operates in the on-state during the demand defrost cycle 406D to reduce the power consumption of TCE unit 100. That said, in other embodiments, the control system 154 may instead control the secondary defrost system(s) to operate in an on-state to reduce the downtime associated with the demand defrost cycle 406D.

At decision 664, the control system 154 operates the air defrost system until a threshold temperature of the coil of the evaporator 142 is reached. It should be appreciated that the threshold temperature of the demand defrost cycle 406D is typically higher than the minimum temperature thresholds of the primary defrost cycle 406B and/or the secondary defrost cycle 406C. For example, the temperature threshold for the demand defrost cycle may be 50° F., 55.0° F., 58.5° F., or a user-programmed temperature value. After the control system 154 detects that the threshold temperature of the coil of the evaporator 142 is reached ("Yes"), the control system 154 may set (666) the indication of defrost cycle type in the memory 156 to indicate the natural defrost cycle 406A and control (668) the components of the TCE unit 100 to execute another on-cycle 402.

As mentioned above, aspects of the systems and methods described herein are controlled by one or more control systems and/or controllers thereof. The one or more control systems may be adapted to run a variety of application programs, access and store data, including accessing and storing data in the associated databases, and enable one or more interactions as described herein. Typically, the control systems is implemented by one or more programmable data processing devices. The hardware elements, operating systems, and programming languages of such devices are conventional in nature, and it is presumed that those skilled in the art are adequately familiar therewith.

The one or more control systems may also include one or more input/output interfaces for communications with one or more processing systems. Although not shown, one or more such interfaces may enable communications via a network, e.g., to enable sending and receiving instructions electronically. The communication links may be wired or wireless.

The one or more control systems may further include appropriate input/output ports for interconnection with one or more output mechanisms (e.g., monitors, printers, touchscreens, motion-sensing input devices, speakers, audio outputs, etc.) and one or more input mechanisms (e.g., keyboards, mice, voice, touchscreens, etc.) serving as one or more user interfaces for the control systems. For example, the one or more control systems may include a graphics subsystem to drive the output mechanism. The links between the control systems and the input or output mechanisms of the system may be wired connections or use wireless communications.

Hence aspects of the systems and methods provided herein encompass hardware and software for controlling the relevant functions. Software may take the form of code or executable instructions for causing a controller or other programmable equipment to perform the relevant steps, where the code or instructions are carried by or otherwise embodied in a medium readable by the controller or other machine. Instructions or code for implementing such operations may be in the form of computer instruction in any form (e.g., source code, object code, interpreted code, etc.) stored in or carried by any tangible readable medium.

As used herein, terms such as computer or machine "readable medium" refer to any medium that participates in providing instructions to a processor for execution. Such a medium may take many forms. Non-volatile storage media include, for example, optical or magnetic disks, such as any of the storage devices in any computer(s) shown in the drawings. Volatile storage media include dynamic memory, such as the memory of such a computer platform. Common forms of computer-readable media therefore include for example: a floppy disk, a flexible disk, hard disk, magnetic tape, any other magnetic medium, a CD-ROM, DVD, any other optical medium, punch cards, paper tape, any other physical medium with patterns of holes, a RAM, a PROM and EPROM, a FLASH-EPROM, any other memory chip or cartridge, or any other medium from which a controller can read programming code and/or data. Many of these forms of computer readable media may be involved in carrying one or more sequences of one or more instructions to a processor for execution.

It should be noted that various changes and modifications to the embodiments described herein will be apparent to those skilled in the art. Such changes and modifications may be made without departing from the spirit and scope of the present invention and without diminishing its attendant advantages. For example, various embodiments of the systems and methods may be provided based on various combinations of the features and functions from the subject matter provided herein.

What is claimed is:

1. A control system for a temperature controlled environment, the control system comprising:

a controller operatively connected to:

an evaporator configured to receive refrigerant that flows from an input of an evaporator coil to an output of the evaporator coil;

a compressor configured to receive the refrigerant from the output of the evaporator coil and compress the received refrigerant;

a condenser configured to receive refrigerant from the compressor, condense the refrigerant, and provide the refrigerant to the input of the evaporator coil; and at least one sensor configured to capture sensor data indicating a temperature associated with the evaporator coil; and one or more memory units communicatively coupled to the controller and storing (i) an indication of a defrost cycle type, and (ii) executable instructions that, when executed by the controller, cause the controller to alternatively:

(a) execute an on-cycle during which the controller controls the compressor to operate in an on-state to cool the temperature controlled environment to a set point temperature; and (b) execute an off-cycle during which:

(i) the controller controls the compressor to operate in an off-state, and (ii) the controller executes a defrost cycle based upon the stored indication of the defrost cycle type.

2. The control system of claim 1, wherein to execute the defrost cycle, the instructions, when executed, cause the controller to:

determine that the stored indication of the defrost cycle type is indicative of a natural defrost cycle; and execute a natural defrost cycle during which defrosting systems of the temperature controlled environment operate in an off-state.

3. The control system of claim 2, wherein the instructions, when executed, cause the controller to:

during the natural defrost cycle, obtain sensor data from the at least one sensor;

compare the obtained sensor data to a temperature threshold; and when the sensor data indicates that the evaporator coil temperature has not risen above the temperature threshold, set the indication of the defrost cycle type to indicate a primary defrost cycle.

4. The control system of claim 1, further comprising:

an air defrost system configured to blow air towards the evaporator coil;

wherein to execute the defrost cycle, the instructions, when executed, cause the controller to:

determine that the stored indication of the defrost cycle type is indicative of a primary defrost cycle; and execute a primary defrost cycle during which the controller controls the air defrost system to operate in an on-state.

5. The control system of claim 4, wherein the instructions, when executed, cause the controller to:

during the primary defrost cycle, obtain sensor data from the at least one sensor;

compare the obtained sensor data to a first temperature threshold; and when the sensor data indicates that the evaporator coil temperature has risen above the first temperature threshold, set the indication of the defrost cycle type to indicate a natural cycle.

6. The control system of claim 4, wherein the instructions, when executed, cause the controller to:

during the primary defrost cycle, obtain sensor data from the at least one sensor;

compare the obtained sensor data to a second temperature threshold, wherein the second temperature threshold is lower than the first temperature threshold; and when the sensor data indicates that the evaporator coil temperature has not risen above the second temperature threshold, set the indication of the defrost cycle type to indicate a secondary defrost cycle.

7. The control system of claim 1, further comprising:

at least one of an electrical defrost system configured to run current through a wire proximate to the evaporator coil or a hot gas defrost system configured to run hot gas in a refrigeration line;

wherein to execute the defrost cycle, the instructions, when executed, cause the controller to:

determine that the stored indication of the defrost cycle type is indicative of a secondary defrost cycle; and execute a secondary defrost cycle during which the controller controls the at least one of the electrical defrost system or the hot gas defrost system to operate in an on-state.

8. The control system of claim 7, wherein the instructions, when executed, cause the controller to:

during the secondary defrost cycle, obtain sensor data from the at least one sensor;

compare the obtained sensor data to a first temperature threshold; and when the sensor data indicates that the evaporator coil temperature has risen above the first temperature threshold, set the indication of the defrost cycle type to indicate a natural cycle.

9. The control system of claim 8, wherein the instructions, when executed, cause the controller to:

when the sensor data indicates that the evaporator coil temperature has not risen above the first temperature threshold for a threshold duration, refrain from executing a subsequent on-cycle.

10. The control system of claim 8, wherein the instructions, when executed, cause the controller to:

when the sensor data indicates that the evaporator coil temperature has not risen above the first temperature threshold for a threshold duration, transmit an alert to an operator associated with the temperature controlled environment.

11. The control system of claim 1, wherein:

the at least one sensor includes a first sensor configured to sense a return airstream temperature prior to the return airstream entering the input of the evaporator coil and a second sensor configure to sense an exhaust air temperature at an output of the evaporator coil; and the instructions, when executed, cause the controller to:

during the on-cycle, determine a performance of the evaporator based upon the exhaust air temperature and the return airstream temperature;

detect that the performance has fallen by a threshold amount; and in response to the determination, set the indication of the defrost cycle type to indicate a primary defrost cycle.

12. The control system of claim 1, further comprising:

an air defrost system configured to blow air towards the evaporator coil;

wherein to execute the defrost cycle, the instructions, when executed, cause the controller to:

determine that the stored indication of the defrost cycle type is indicative of a demand defrost cycle; and execute a demand defrost cycle during which the controller controls the air defrost system to operate in an on-state, wherein during the demand defrost cycle, the controller is configured to:

obtain sensor data from the at least one sensor;

continue to operate the air defrost system in the on-state until the sensor data indicates a threshold temperature has been reached.

13. The control system of claim 1, wherein parameters associated with the defrost cycle are user programmable.

14. The control system of claim 13, wherein the parameters associated with the defrost cycle include the indication of the defrost cycle type.

15. A method for operating a control system of a temperature controlled environment comprising (i) a controller operatively connected to (a) an evaporator configured to receive refrigerant that flows from an input of an evaporator coil to an output of the evaporator coil; (b) a compressor configured to receive the refrigerant from the output of the evaporator coil and compress the received refrigerant; a condenser configured to receive refrigerant from the compressor, condense the refrigerant, and provide the refrigerant to the input of the evaporator coil; and (c) at least one sensor configured to capture sensor data indicating a temperature associated with the evaporator coil; and (ii) one or more memory units communicatively coupled to the controller and storing an indication of a defrost cycle type, the method comprising:

alternating, by the control system, between:

(a) executing an on-cycle comprising:

controlling, by the controller, the compressor to operate in an on-state to cool the temperature controlled environment to a set point temperature; and (b) executing an off-cycle comprising:

(i) controlling, by the controller, the compressor to operate in an off-state, and (ii) executing, by the controller, a defrost cycle based upon the stored indication of the defrost cycle type.

16. A non-transitory computer readable medium storing instructions that, when executed by a control system of a temperature controlled environment, cause the control system to perform the method of claim 15.

17. The method of claim 15, wherein to executing the defrost cycle comprises:

determining, by the controller, that the stored indication of the defrost cycle type is indicative of a natural defrost cycle; and executing, by the controller, a natural defrost cycle during which defrosting systems of the temperature controlled environment operate in an off-state.

18. The method of claim 17, further comprising:

during the natural defrost cycle, obtaining, by the controller, sensor data from the at least one sensor;

comparing, by the controller, the obtained sensor data to a temperature threshold; and when the sensor data indicates that the evaporator coil temperature has not risen above the temperature threshold, setting, by the controller, the indication of the defrost cycle type to indicate a primary defrost cycle.

19. The method of claim 15, wherein the control system further comprises an air defrost system configured to blow air towards the evaporator coil, and the method further comprises:

determining, by the controller, that the stored indication of the defrost cycle type is indicative of a primary defrost cycle; and executing, by the controller, a primary defrost cycle during which the controller controls the air defrost system to operate in an on-state.

20. The method of claim 15, wherein the control system further comprises at least one of an electrical defrost system configured to run current through a wire proximate to the evaporator coil or a hot gas defrost system configured to run hot gas in a refrigeration line, and the method further comprises:

determining, by the controller, that the stored indication of the defrost cycle type is indicative of a secondary defrost cycle; and executing, by the controller, a secondary defrost cycle during which the controller controls the at least one of the electrical defrost system or the hot gas defrost system to operate in an on-state.

* * * * *